United States Patent [19]

Kergomard et al.

[11] Patent Number: 4,714,001

[45] Date of Patent: Dec. 22, 1987

[54] DEVICE FOR OBTAINING QUARTER-TONES AND OTHER MICRO-INTERVALS ON MUSICAL WIND INSTRUMENTS WITH LATERAL HOLES

[75] Inventors: Jean Kergomard, Coulans sur Gee; Xavier Meynial, Gif sur Yvette, both of France

[73] Assignees: Centre National de la Recherche Scientifique; Institut de Recherche et de Coordination Acoustique Musique IRCAM, both of Paris, France

[21] Appl. No.: 909,333

[22] Filed: Sep. 19, 1986

[51] Int. Cl.[4] ..... G10D 7/00

[52] U.S. Cl. ..... 84/386; 84/380 R; 84/394

[58] Field of Search ..... 84/380–386, 84/394

[56] References Cited

U.S. PATENT DOCUMENTS

| | | | |
|---|---|---|---|
| 1,767,998 | 6/1930 | Parkinson | 84/384 |
| 1,802,791 | 4/1931 | Stover | 84/385 R |
| 2,951,414 | 9/1960 | Christensen | 84/382 |
| 3,783,732 | 1/1974 | Ihara | 84/385 |
| 4,515,060 | 5/1985 | Ferron | 84/380 R |

FOREIGN PATENT DOCUMENTS

| | | |
|---|---|---|
| 0085001 | 3/1983 | European Pat. Off. . |
| 2529364 | 12/1983 | France . |

OTHER PUBLICATIONS

A. Baines: "Bagpipes", 1973, pp. 77–79, University Press, Oxford, GB.

*Primary Examiner*—Lawrence R. Franklin

*Attorney, Agent, or Firm*—Oblon, Fisher, Spivak, McClelland & Maier

[57] ABSTRACT

For each register of the instrument, the device comprises at least one auxiliary tube branched in the vicinity of the head of the instrument and a manual control mechanism making it possible to open or close the auxiliary tube at its first end in contact with the instrument or at its second end turned towards the outside.

This device more particularly applies to flute mouthpiece instruments or reed instruments, such as clarinets, saxophones, oboes and bassoons.

7 Claims, 14 Drawing Figures

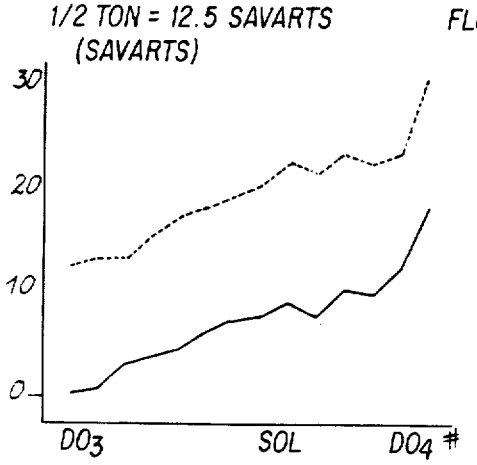
FIG 9a
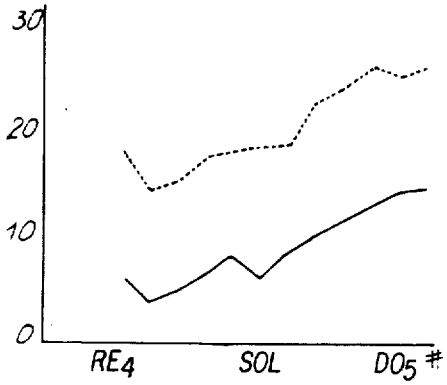
FIG 9b
FIG. 10a
CLARINET
FIG. 10b
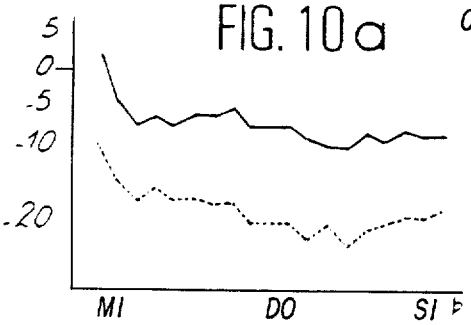
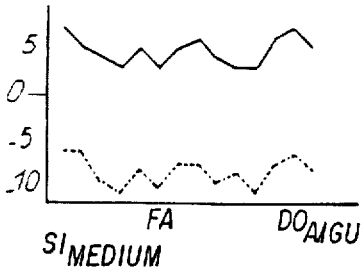
FIG. 11a
SAXOPHONE
FIG. 11b
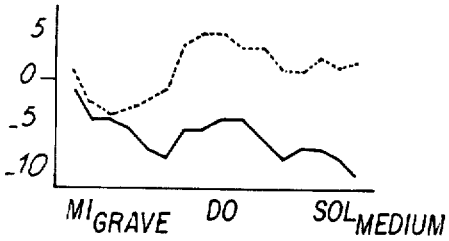
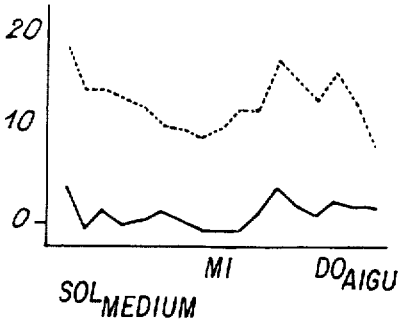

DEVICE FOR OBTAINING QUARTER-TONES AND OTHER MICRO-INTERVALS ON MUSICAL WIND INSTRUMENTS WITH LATERAL HOLES

BACKGROUND OF THE INVENTION

The present invention relates to devices for obtaining quarter-tones and other micro-intervals on wind instruments with lateral holes and more particularly on flute mouthpiece instruments, or reed instruments such as clarinets, saxophones, oboes and bassoons.

At present, for playing quarter-tones, the instrumentalist has to learn the same number of new fingerings as for normal playing and in addition all quarter-tone intervals cannot be obtained on all instruments. Moreover the solution consisting of doubling the number of keys is made impossible due to prohibitive costs and handling difficulties.

On certain traditional instruments, such as certain Hungarian bagpipes and reed pipes, it is known to translate the scale by a half-tone on an octave by using a hole made in the instrument wall which, when open, raises all the notes by a half-tone. This method, on which information is given hereinafter, is described in the article by A. BAINES, entitled BAGPIPES, Oxford University Press, 1973.

SUMMARY OF THE INVENTION

The object of the present invention is to obviate the aforementioned difficulties by supplying devices making it possible to translate the complete scale of an instrument, particularly a quarter-tone, in a simple manner and whilst eliminating any complicated fingering.

According to the present invention, a device comprises at least one auxiliary tube branched in the vicinity of the head of the instrument and a manual control mechanism comprising means to selectively close the auxiliary tube at its first end in contact with the instrument and to selectively open its second end turned towards the outside.

In the case of a flute, use is made of two auxiliary tubes branched in the vicinity of the head of the flute.

In the case of a transverse or cross flute, each of the two auxiliary tubes is mounted between the mouthpiece and the trill clef, for the first register its section S and its height h being such that S/h is between 0.2 and 0.7 mm with h between 30 and 120 mm, which gives for its diameter a value d between 2.7 and 9.9 mm. For the second register, its section S and height h are such that S/h is between 1 and 2.5 mm with h between 10 and 40 mm, which gives for its diameter d a value between 3.5 and 11.3 mm.

The device for a clarinet comprises at least one auxiliary mounted on the cylinder, mouthpiece or upper part of the body and a mechanism making it possible to close the tube or tubes, at least at one or other of their ends.

In the particular example of a B-flat clarinet, the device comprises an auxiliary tube corresponding to the first register mounted on the cylinder or on the upper part of the upper body and whose volume is between 2 and 5 $cm^3$ and an auxiliary tube corresponding to the second register, this being mounted on the cylinder, mouthpiece or upper body and whose volume is between 1 and 4 $cm^3$. A manual control mechanism makes it possible to close the tube at at least one of its two ends and optionally an intermediate position between these two ends.

In the case of the saxophone and particularly the alto saxophone, the device comprises an auxiliary tube for the first register mounted on the bend, its section and height being such that S/h is between 0.08 and 0.3 mm with h between 10 and 250 mm, which for its diameter d gives a value between 1.4 and 6.2 mm. The device also comprises a first tube corresponding to the second register and which is mounted on the first half of the bend adjacent to the opening, its section and height being such that S/h is between 0.15 and 0.5 mm and its height is between 10 and 50 mm, so that for its diameter a value d between 1.4 and 5.6 mm is obtained, as well as a second tube for the second register which is mounted on the second half of the bend or on the top of the body, its section and height being such that S/h is between 0.7 and 2.6 mm with h between 5 and 20 mm, so that for its diameter a value between 2.1 and 8.1 mm is obtained.

Certain definitions and results of experiments will now be given making it possible to justify the choice of dimensions for the devices.

1. Definitions of the Intervals and Registers

For a given instrument, the calculation of the dimensions of the device is dependent on the considered register and the adopted micro-interval. The latter is defined by a relative increase of frequency A or a relative decrease of frequency D. The following table gives the values A and D for the main intervals:

| Interval | A | D |
|---|---|---|
| $\frac{1}{8}$ | 0.0145 | 0.0143 |
| $\frac{1}{4}$ | 0.0253 | 0.0285 |
| $\frac{1}{3}$ | 0.0393 | 0.0378 |
| $\frac{1}{2}$ | 0.0595 | 0.0561 |
| $\frac{2}{3}$ | 0.0801 | 0.07413 |
| 1 | 0.1225 | 0.1091 |

for an interval of one nth of a tone then $$A = 2^{\frac{1}{6x}} - 1 \text{ and } D = 1 - 2^{-\frac{1}{6x}}$$

To the nth register of such an instrument corresponds a frequency interval between $f_{min}$ (low-pitched) and $f_{max}$ (high-pitched). For the main instruments, the notes to which these intervals correspond are as follows:

| Instrument | First register | second register |
|---|---|---|
| Transverse flute | Low C to medium C# | Medium D to high C# |
| Oboe | Low B to medium C# | Medium D to high C# |
| Saxophone | Low B to medium C# | Medium D to high F# |
| Bassoon | Low B to medium F | Medium $F_{II}$ to high F |
| Clarinet | Low E to medium B | Medium B to high C |

For the saxophone and clarinet, which are transposing instruments, the notes indicated are the notes written on the score and not the notes which are heard. For the instruments of the same non-transposing group such as the flute, oboe, bassoon, it is merely necessary to translate the notes given here.

2. Octaving Instruments: Open Tube Systems (a) Principle

In order to obtain a relative increase of the frequency A of the nth register of the instrument [$f_{min}$, $f_{max}$], the open tube must be spaced from the exciter or instigator by approximately $$l_o = \frac{c}{8f_{min}}(1 + 2n\,A)$$

in which c is the speed of sound (c = 345 cm/s at 22° C.).

This tube of height h and section S must be such that its acoustic "inertia" (cf below) is:

$$L = \frac{l_o}{S}\ \frac{0.3}{hA}$$

in which S is the internal section of the instrument at the location of the open tube. The density of air is estimated as being equal to 1 for simplification reasons.

The two above relations must be observed to within 50%. What is stated hereinafter defines the notions of inertia and distance from the exciting system.

(b) Definition of the inertia

The quatity S/h with respect to the flute is a simplification of the quantity:

$$\frac{\pi R^2}{h + 1.4R} = \frac{1}{L}$$

which is the inverse of the acoustic inertia L, representing the inertia of the air in the tube (cf BERANEK, ACOUSTICS, 1954, P. 131, MCGRAW HILL, NEW YORK).

Results are given hereinafter of experiments carried out more particularly on the transverse flute, a B-flat clarinet and an alto saxophone.

Flute: 1st register

The auxiliary tube is mounted on the head of the flute, its dimensions being such that S/h is between 0.2 and 0.7 mm with h between 30 and 110 mm and e.g. for:

| | |
|---|---|
| h = 30 mm | d is between 2.7 and 5.2 mm, |
| h = 110 mm | d is between 5.3 and 9.9 mm. |

flute: 2nd register

The auxiliary tube is mounted on the head of the flute, its dimensions being such that S/h is between 1 and 2.5 mm with h between 10 and 40 mm, e.g. for:

| | |
|---|---|
| h = 10 mm | d is between 3.5 and 5.7 mm, |
| h = 40 mm | d is between 7.1 and 11.3 mm. |

Clarinet: 1st register

The auxiliary tube is mounted on the cylinder or the top of the upper body and its volume is between 2 and 5 cm Clarinet: 2nd register The auxiliary tube is mounted on the cylinder, the mouthpiece or upper body and its volume is between 1 and 4 $cm^3$.

Alto saxophone: 1st register

The auxiliary tube is mounted on the mouthpiece, its dimensions being such that S/h is between 0.08 and 0.3 mm with h between 10 and 250 mm, e.g. for:

| | |
|---|---|
| h = 20 mm | d is between 1.4 and 2.8 mm, |
| h = 100 mm | d is between 3.2 and 6.2 mm. |

Alto saxophone: 2nd register

This first auxiliary tube is mounted on the first half of the bend. The ratio S/h is between 0.15 and 0.5 mm with h 5 and 100 mm, e.g. for:

| | |
|---|---|
| h = 10 mm | d is between 1.4 and 2.5 mm, |
| h = 50 mm | d is between 3.1 and 5.6 mm. |

The second auxiliary tube is mounted on the second half of the bend or on the top of the body. The ratio S/h is between 0.7 and 2.6 mm with h between 5 and 30 mm, e.g. for:

| | |
|---|---|
| h = 5 mm | d is between 2.1 and 4.1 mm, |
| h = 20 mm | d is between 4.2 and 8. mm. |

BRIEF DESCRIPTION OF THE DRAWINGS

The invention is described in greater detail hereinafter relative to non-limitative embodiments and the attached drawings, wherein show:

FIGS. 9*a* and 9*b*, pitch variation curves respectively for the first and second registers of the transverse flute.

FIGS. 10*a* and 10*b*, the pitch variation curves respectively for the first and second registers of the B-flat clarinet.

FIGS. 11*a* and 11*b*, the pitch variation curves respectively for the first and second registers of the alto saxophone.

DETAILED DESCRIPTION OF THE PREFERRED EMBODIMENTS

Figure 1:
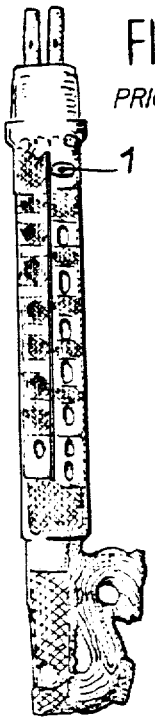
FIG. 1 PRIOR ART
FIGS. 1 and 2, respectively side and rear views of a known Hungarian bagpipe element.
Figure 2:
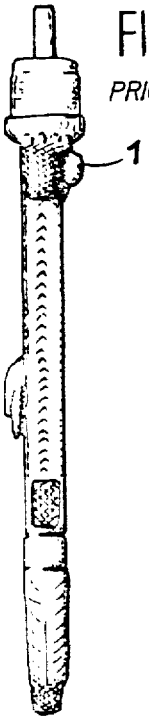
FIG. 2 PRIOR ART

The Hungarian bagpipe element normally called a chanter shown in FIGS. 1 and 2 is a pipe which gives the melody and which can therefore be likened to a oboe. In its upper part is provided a very small hole 1 made through a relatively thick wall. When this hole is open, it increases the pitch of most notes by approximately a semitone and is often used for giving the effect of a transitory vibrato on these notes.

The principle of using this hole is not very well known and it is only used on relatively high-pitched instruments in a rather approximate manner. It cannot be applied either to low-pitched registers or to instruments having thin walls, such as BOEHM system flutes and saxophones. It can also not be applied to the clarinet.

Figure 3:
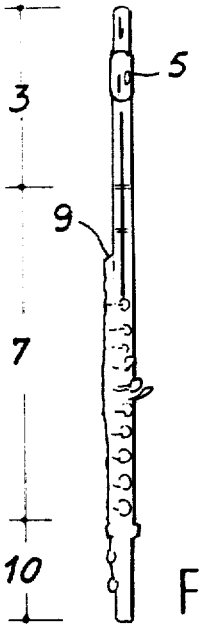
FIG. 3 PRIOR ART

In the case of the flute shown in FIG. 3, it is possible to see the head 3 and its mouthpiece or opening 5, the body 7 and its trill clef 9 and C clef 10. The two auxiliary tubes corresponding to the first and second registers of this instrument are fitted between mouthpiece 5 and the trill clef 9.

Figure 4:
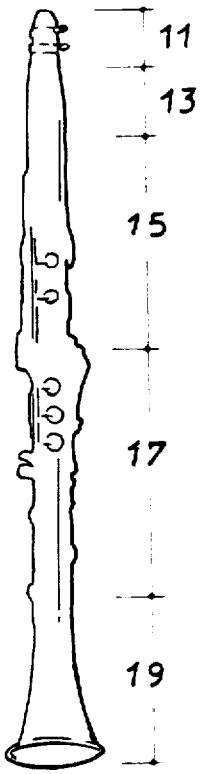
FIG. 4 PRIOR ART
FIGS. 3, 4, 5, respectively a flute, clarinet and a saxophone.

In the case of the clarinet shown in FIG. 4, it is possible to see the mouthpiece 11, cylinder 13, upper body 15, lower body 17 and the bell or opened-out region 19. The auxiliary tube corresponding to the first register is fitted between cylinder 13 and upper body 15, whilst the auxiliary tube corresponding to the second register is fitted on cylinder 13, mouthpiece 11 or upper body 15.

Figure 5:
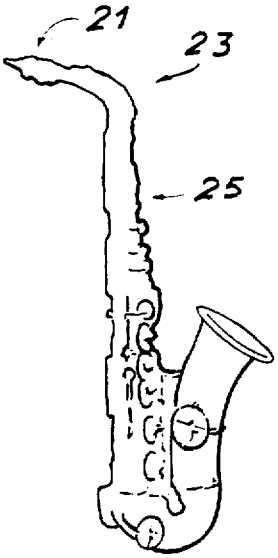
FIG. 5 PRIOR ART.

In the case of the saxophone shown in FIG. 5, it is possible to see the mouthpiece 21, bend 23 and body 25. The auxiliary tube corresponding to the first register is mounted on bend 23, whereas the first tube of the second register is mounted on the first half of bend 23 adjacent to the mouthpiece and the second tube of the second register is mounted on the second half of the bend 23 or on the top of body 25.

Figure 6:
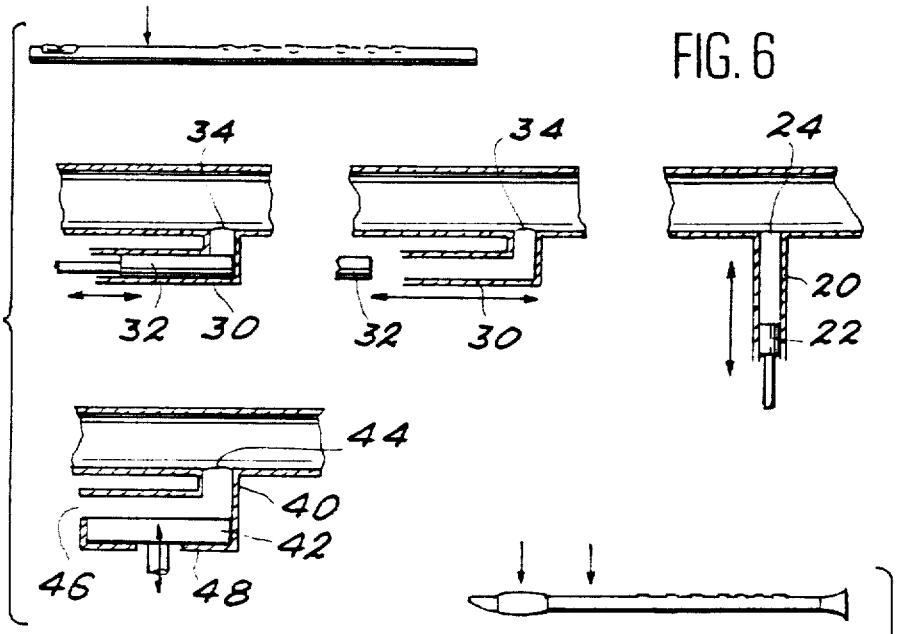
FIG. 6, diagrammatically a flute and opening and closing mechanisms for the auxiliary tubes.

FIG. 6 shows three embodiments of the device according to the invention.

According to a first embodiment, the auxiliary tube 20 is mounted perpendicular to the axis of the flute. A valve 22 comprises means to selectively block the tube 20 adjacent the instrument and to selectively open its other end. The valve 22 moves within the tube between a position where it is fully inserted to block the opening 24 common to the flute and the tube and a second position where it is located entirely outside the tube and so opens the tube.

According to a second embodiment, the auxiliary tube 30 is mounted parallel to the flute axis. Valve 32 moves between a position where it is entirely inserted blocking the opening 34 common to the flute and the tube and a position where it is completely outside the tube, so that the latter is completely open.

According to a third embodiment, the auxiliary tube 40 is mounted parallel to the flute axis, but is equipped with a valve 42 moving parallel to the flute axis between a position where it is completely inserted so as to block both the opening 44 common to the flute and the tube and the opening 46 for the removal of the tube and a position where it is in contact with the lower wall 48 of the tube, opening 46 being opened.

It is pointed out that in these three exemplified embodiments, the valve moves between a position of closing the opening common to the flute and tube, in which case a standard flute is involved, and a position where the tube is completely open both towards the flute and towards the outside, in which case the flute has notes raised by a quarter-tone. This property has been experimentally proved and can clearly be gathered from examining the curves in FIGS. 9*a* and 9*b* respectively corresponding to the first and second registers. It is pointed out that all the curves shown in continuous lines relate to standard instruments, whereas those in dotted line form relate to instruments equipped with devices according to the invention.

Figure 7:
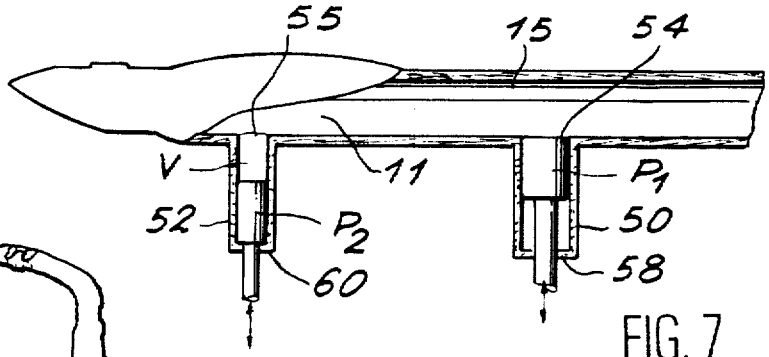
FIG. 7, diagrammatically a clarinet equipped with two auxiliary tubes.

The clarinet shown in FIG. 7 is equipped with two auxiliary tubes, namely a first tube 50 corresponding to the first register mounted on the upper part of upper body 15 and a second tube 52 corresponding to the second register mounted on mouthpiece 11. Each valve P1, P2 can move between a position closing opening 54, 55 where it blocks the auxiliary tube 50, 52 and a position where it strikes against the bottom 58, 60 of the tube and where a certain tube volume V is linked with the air column of the clarinet.

It is pointed out that when openings 54, 55 are blocked by valves P1, P2 respectively, a normal clarinet is involved. However, when the valves P1, P2 strike against the walls 58, 60 of the tubes, the clarinet air column is increased by two volumes V and the two registers are lowered by a quarter-tone, as can be gathered from FIGS. 10*a* and 10*b*, where the curves respectively relate to the first and second registers.

Figure 8:
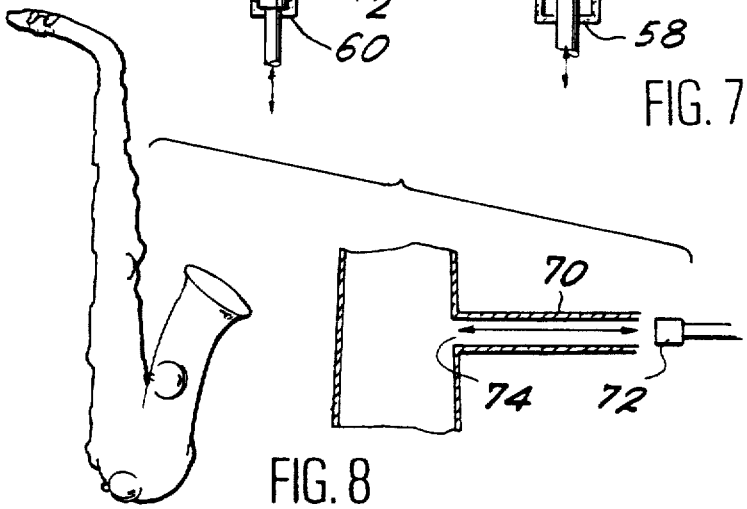
FIG. 8, diagrammatically a saxophone and an auxiliary tube.

In the case of a saxophone and as stated herein before, the device according to the invention comprises three tubes, one of them being diagrammatically shown in FIG. 8. It can be seen that tube 70 is mounted perpendicular to the saxophone axis. This tube is internally traversed by a valve 72, which functions in the same way as the flute valves between a position where opening 74 is blocked and a position where the valve is completely outside the tube. When the three saxophone tubes are unblocked, the two registers are raised by a quarter-tone, as can be gathered from the curves 11*a* and 11*b*.

It is obvious that the above embodiments have only been given in an illustrative manner and that numerous modifications and variations can be made thereto without passing beyond the scope of the invention. In particular, it is obvious that the tubes could be given widely varying shapes according to the requirements of technology and that the choice of the valve control mechanisms is a function of the instrument involved.

What is claimed is:

1. A device for obtaining quarter-tones and other micro-intervals on musical wind instruments with lateral holes, comprising for each register of the instrument at least one auxiliary tube branched in the vicinity of the instrument head, said at least one auxiliary tube having a first end in contact with said instrument and a second open end, and a manual control mechanism comprising means to selectively block each said at least one auxiliary tube adjacent said first end and to selectively open the second end.

2. A device according to claim 1, wherein the instrument is a flute, which comprises two said auxiliary tubes branched in the vicinity of its head, wherein said manual control mechanism comprises a valve mechanism.

3. A device according to claim 2, wherein the instrument is a transverse or cross flute, each said auxiliary tube being mounted between the mouthpiece and the trill clef for the first register, a section S and a height h thereof being such that S/h is between 0.2 and 0.7 mm with h between 30 and 110 mm and a diameter d between 2.7 and 9.9 mm, for the second register the section S and height h are such that S/h is between 1 and 2.5 mm with h between 10 and 40 mm and the diameter d between 3.5 and 11.3 mm.

4. A device according to claim 1, wherein the instrument is a clarinet comprising at least one said auxiliary tube mounted on one of the cylinder, the mouthpiece and a part of the body.

5. A device according to claim 4, wherein the instrument is a B-flat clarinet, the auxiliary tube corresponding to the first register being mounted on one of the cylinder and the upper part of the upper body and having a volume between 2 and 5 $cm^3$, the auxiliary tube corresponding to the second register being mounted on one of the cylinder, mouthpiece and upper body and having a volume between 1 and 4 $cm^3$.

6. A device according to claim 1, wherein the instrument is a saxophone and comprises an auxiliary tube for a first register and two auxiliary tubes for the second register.

7. A device according to claim 6, wherein the saxophone is an alto saxophone, the auxiliary tube of the first register being mounted on the bend, a S/h section and a height h thereof being such that S/h is between 0.08 and 0.3 mm with a height h between 10 and 250 mm and a diameter d between 1.4 and 6.2 mm, the first tube of the second register being mounted on the first half of the bend adjacent to the mouthpiece, the section and height thereof being such that S/h is between 0.15 and 0.5 mm with a height h between 10 and 50 mm and the diameter d between 1.4 and 5.6 mm, the second tube of the second register being mounted on the second half of the bend or on the top of the body, the section and height thereof being such that S/h is between 0.7 and 2.6 mm, with a height h between 5 and 20 mm and a diameter d between 2.1 and 8.1 mm.

* * * * *

UNITED STATES PATENT AND TRADEMARK OFFICE

CERTIFICATE OF CORRECTION

PATENT NO. : 4,714,001

DATED : December 22, 1987

INVENTOR(S) : Jean Kergomard et al.

It is certified that error appears in the above-identified patent and that said Letters Patent is hereby corrected as shown below:

-- Priority data is omitted from Letters Patent.
It should read:

September 19, 1985 [FR] France.....85 13893--

Signed and Sealed this

Twenty-first Day of June, 1988

*Attest:*

DONALD J. QUIGG

*Attesting Officer*

*Commissioner of Patents and Trademarks*